US006202846B1

(12) United States Patent
Hess

(10) Patent No.: US 6,202,846 B1
(45) Date of Patent: Mar. 20, 2001

(54) DECORATIVE ENHANCEMENT FOR HANDBAG OR CARRYING CASE

(76) Inventor: Michael J. Hess, 138 Woodland Rd., Pittsford, NY (US) 14534

( * ) Notice: Subject to any disclaimer, the term of this patent is extended or adjusted under 35 U.S.C. 154(b) by 0 days.

(21) Appl. No.: 09/496,454

(22) Filed: Feb. 2, 2000

(51) Int. Cl.[7] ..... B65D 33/00; A45C 1/02

(52) U.S. Cl. ..... 206/457; 150/128; 493/84

(58) Field of Search ..... 150/103, 128, 150/130; 190/126, 127; 206/457; 362/156; 493/84, 89

(56) References Cited

U.S. PATENT DOCUMENTS

D. 164,621 * 9/1951 Bienen ..... 150/103
5,355,289 * 10/1994 Krenn ..... 362/253
5,503,204 * 4/1996 Byers et al. ..... 150/103
6,082,867 * 7/2000 Chien ..... 362/156
6,085,698 * 7/2000 Klein ..... 119/859

* cited by examiner

*Primary Examiner*—Jim Foster
(74) *Attorney, Agent, or Firm*—Robert J. Bird

(57) ABSTRACT

A carrying case includes a panels forming an enclosure, with welting along seams between adjoining panels and along the panel free edges. The welting includes a tube of light-transmissive material. A wire is removably inserted into the tube, the wire having a decorative surface color or design visible through the wall of the tube for decorative effect. The tube also acts as a cylindrical lens to magnify the appearance of the wire. A removable cap on one end of the tube prevents the wire from sliding out of the tube. The tube might be either transparent or translucent. The wire is interchangeable with other wires of different colors or designs to vary the decorative effect.

6 Claims, 1 Drawing Sheet

DECORATIVE ENHANCEMENT FOR HANDBAG OR CARRYING CASE

BACKGROUND OF THE INVENTION

This invention relates to carrying cases, and more specifically to a system of piping or welting to give a changeable decorative effect to a carrying case. The term "carrying case" is intended to include handbags, luggage, portfolios, satchels, purses, and the like.

Carrying cases often include piping or welting stitched along seams or along edges as trimming, to cover the seams and edges and to give them an aesthetic appearance. Welting that I am aware of is of a single color, typically the color of the case itself, or of a lighter or darker shade of that color to harmonize with it. Welting of that kind is the most relevant prior art that I know of.

SUMMARY OF THE INVENTION

A carrying case according to this invention includes a panels forming an enclosure, with welting along seams between adjoining panels and along the panel free edges. The welting includes a tube of light-transmissive material. A wire is removably inserted into the tube, the wire having a decorative surface color or design visible through the wall of the tube for decorative effect. The tube also acts as a cylindrical lens to magnify the appearance of the wire. A removable cap on one end of the tube prevents the wire from sliding out of the tube. The tube might be either transparent or translucent. The wire is interchangeable with other wires of different colors or designs to vary the decorative effect.

DETAILED DESCRIPTION

Figure 1:
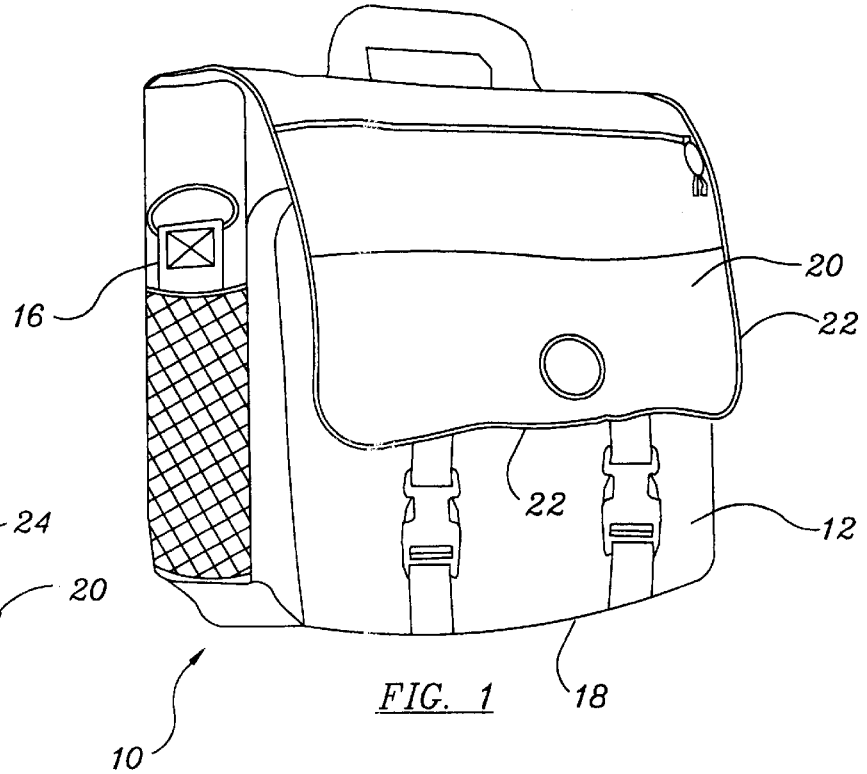
FIG. 1 is a front pictorial view of a carrying case which includes the system of decorative welting of this invention.

Referring to the drawing, a carrying case 10 primarily includes a front panel 12, back panel 14, side panels 16, bottom panel 18, and a cover panel 20 extending over the top of the case and down over the front panel 12.

The cover panel or flap 20 includes welting 22 along its side and bottom edges, as best seen in FIG. 1. The welting 22 is a transparent or translucent tube 24 of a plastic material. The tube 24 is open or accessible at one or both ends. A colored wire 26 is removably inserted into and through the tube 24. The wire 26 is visible through the transparent (or translucent) wall of the tube 24 to give decorative effect to the welting. If the tube 24 is transparent, the wire 26 is clearly visible through the tube wall and remains clearly defined. If the tube 24 is translucent, the outline of the wire is visually softened and its color correspondingly scattered and softened by the tube wall. In either case, the tube 24 also acts as a cylindrical lens of very short focal length to magnify the appearance of the wire 26 to the outside observer.

Figure 3:
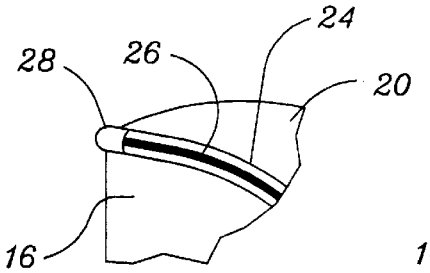
FIG. 3 is an enlarged detail view of the upper left corner of FIG. 1.
Figure 2:
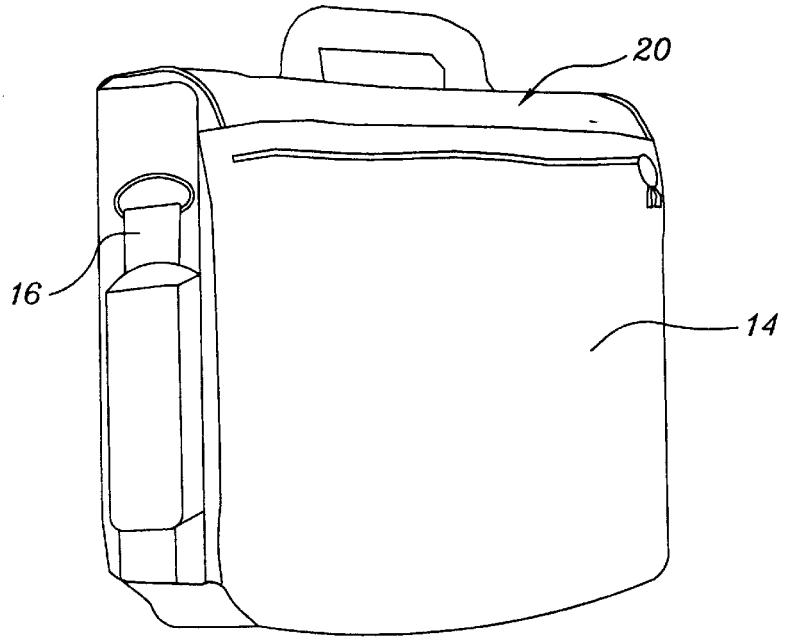
FIG. 2 is a pictorial view of the carrying case of FIG. 1.

The enlarged detail view of FIG. 3 is provided to more clearly show the wire 26 within the tube 24. The tube 24 includes a removable cap or similar closure device 28 on one end to prevent the wire 26 from sliding out of the tube.

The wire 26 might be of a color like that of the case itself, or a harmonizing shade of that color, or it might be a bright decorative color, or a bright decorative design (e.g. candy stripes). The point here is that the wire 26 is removable from the tube 24 and interchangeable with other wires of different colors or designs, thereby to alter the decorative appearance of the case.

The tubular welting 24 and wire 26 are shown and described as being on the peripheral edges of the carrying case cover panel 20. This is only for the sake of simplicity of illustration and description. Clearly, the tubular trim concept of this invention is applicable to other seams and/or edges on the carrying case.

The foregoing description of a preferred embodiment of this invention, including any dimensions, angles, or proportions, is intended as illustrative. The concept and scope of the invention are limited only by the following claims and equivalents thereof.

What is claimed is:

1. A carrying case including a plurality of panels forming an enclosure therebetween, with welting along free edges of said panels;

said welting including a tube of light-transmissive material;

a wire removably inserted into said tube, said wire having a decorative surface color or design visible through the wall of said tube for decorative effect, said tube acting as a cylindrical lens to magnify the appearance of said wire; and a removable cap on one end of said tube to prevent said wire from sliding therefrom.

2. A carrying case as defined in claim 1, further including said welting along seams between adjoining panels.

3. A carrying case including a plurality of panels forming an enclosure therebetween, with welting along seams between adjoining panels and along free edges of said panels;

said welting including a tube of light-transmissive material;

a wire removably inserted into said tube, said wire having a decorative surface color or design visible through the wall of said tube for decorative effect, said tube acting as a cylindrical lens to magnify the appearance of said wire; and a removable cap on one end of said tube to prevent said wire from sliding therefrom.

4. A carrying case as defined in claim 3, in which said tube is transparent.

5. A carrying case as defined in claim 3, in which said tube is translucent to soften the external appearance of said wire.

6. A method of altering the visual effect of a carrying case having panels with light-transmissive tubular welting along seams between adjoining panels and along free edges of said panels, including the following steps:

selecting one of a plurality of wires, each of said wires having a different decorative surface color or design;

inserting said wire into said tubular welting whereby said wire is visible through the wall of said tube; and closing said tube to prevent said wire from sliding therefrom.

* * * * *